US007419245B2

(12) United States Patent
Chikamoto

(10) Patent No.: US 7,419,245 B2
(45) Date of Patent: Sep. 2, 2008

(54) INK-JET HEAD

(75) Inventor: Tadanobu Chikamoto, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 97 days.

(21) Appl. No.: 10/913,479

(22) Filed: Aug. 9, 2004

(65) Prior Publication Data

US 2005/0083379 A1 Apr. 21, 2005

(30) Foreign Application Priority Data

Aug. 14, 2003 (JP) ..... 2003-293521

(51) Int. Cl.
*B41J 2/14* (2006.01)
*B41J 2/045* (2006.01)

(52) U.S. Cl. ..... 347/50; 347/71

(58) Field of Classification Search ..... 347/50, 347/68–72

See application file for complete search history.

(56) References Cited

U.S. PATENT DOCUMENTS

| | | | | |
|---|---|---|---|---|
| 5,581,288 | A * | 12/1996 | Shimizu et al. | 347/87 |
| 6,027,208 | A * | 2/2000 | Amano | 347/70 |
| 6,631,981 | B2 | 10/2003 | Isono et al. | |
| 2002/0024568 | A1 | 2/2002 | Ito et al. | |
| 2003/0090540 | A1 | 5/2003 | Shimizu | |

FOREIGN PATENT DOCUMENTS

| | | | |
|---|---|---|---|
| CZ | EP 1 336 491 | A1 * | 8/2003 |
| EP | 1 316 426 | A1 | 6/2003 |
| JP | A 05-246044 | | 9/1993 |
| JP | A 2001-10037 | | 1/2001 |
| JP | A 2001-179973 | | 7/2001 |
| JP | A 2002-19102 | | 1/2002 |
| JP | A 2002-144582 | | 5/2002 |
| JP | A 2003-080703 | | 3/2003 |
| JP | A 2003-145791 | | 5/2003 |

OTHER PUBLICATIONS

English translation of Office Action for Japanese Patent Application No. 2003-293521, Mailed Sep. 5, 2006.

* cited by examiner

*Primary Examiner*—Stephen D. Meier
*Assistant Examiner*—Geoffrey Mruk
(74) *Attorney, Agent, or Firm*—Oliff & Berridge, PLC

(57) ABSTRACT

An ink-jet head comprises a passage unit, a reservoir unit, an actuator unit, and a flexible cable. The reservoir unit stores ink in an ink reservoir, and supplies the ink into the passage unit. The actuator unit is fixed to a portion of the passage unit spacedly confronting the reservoir unit. The flexible cable is connected with the actuator unit in order to supply a drive signal to the actuator unit. A channel is formed in the reservoir unit, the channel penetrating through the reservoir unit in a direction across a face of the passage unit where the actuator unit is fixed. The flexible cable connected with the actuator unit is extended out through the channel.

14 Claims, 10 Drawing Sheets

INK-JET HEAD

BACKGROUND OF THE INVENTION

1. Field of the Invention

The present invention relates to an ink-jet head that ejects ink onto a record medium and thereby conducts a recording.

2. Description of Related Art

An ink-jet head is applicable to a recording apparatus such as printers and facsimile machines, etc. The ink-jet head comprises a passage unit that includes a plurality of nozzles and pressure chambers, an actuator that selectively applies ejection energy to ink contained in the respective pressure chambers, and the like.

One of known actuators has a layered structure of a plurality of piezoelectric sheets made of piezoelectric ceramic (see U.S. Pat. No. 6,631,981). With such a construction, the actuator is fixed onto a face of a passage unit opposite to a face thereof provided with nozzles, and the actuator is connected with a flexible cable acting as a power supply member. One end portion of the flexible cable connected with the actuator extends along a plane of the piezoelectric sheet.

The ink-jet head sometimes further includes a reservoir unit that stores ink having supplied from an ink supply source such as an ink tank and supplies the ink to the passage unit. The reservoir unit is fixed to the passage unit in such a manner that a portion thereof can spacedly confront the passage unit. The actuator is fixed to a portion of the passage unit spacedly confronting the reservoir unit.

One end of the flexible cable is connected with the actuator unit, and the other end thereof is extended out along an outer face of the reservoir unit toward a side of the reservoir unit away from the passage unit, in order that the other end can be connected with a control substrate, etc., that controls driving of the head.

SUMMARY OF THE INVENTION

When the flexible cable is extended out along the outer face of the reservoir unit in the way as described above, a width of the head becomes larger because it includes an extent of the cable protruding outward beyond a width of the reservoir unit. Particularly when an FPC (i.e., Flexible Printed Circuit) is adopted as the flexible cable, it is preferable to provide a covering at an exterior of the FPC in order to prevent ink from adhering to the FPC, because the FPC is easily corroded by ink. Since the covering is provide at the exterior of the flexible cable that has been extended out along the outer face of the reservoir unit, the width of the head is further increased.

An object of the present invention is to provide an ink-jet head capable of downsizing the head itself.

According to an aspect of the present invention, there is provided an ink-jet head comprising a passage unit, a reservoir unit, an actuator unit, and a flexible cable. The passage unit includes a plurality of nozzles that eject ink, a plurality of pressure chambers that communicate with the respective nozzles, and an ink receiving port opening thereon and communicating with the pressure chambers. The reservoir unit includes an ink discharge port opening thereon and an ink reservoir that stores ink. The reservoir unit is fixed to the passage unit such that a portion thereof can spacedly confront the passage unit with the ink discharge port and the ink receiving port connected with each other, to thereby supply the ink stored within the ink reservoir into the passage unit via the ink discharge port and the ink receiving port. The actuator unit is fixed to a portion of the passage unit spacedly confronting the reservoir unit and applies ejection energy to ink contained in the pressure chambers. The flexible cable is connected with the actuator unit in order to supply a drive signal to the actuator unit. A channel is formed in the reservoir unit, the channel penetrating through the reservoir unit in a direction across a face of the passage unit where the actuator unit is fixed. The flexible cable connected with the actuator unit is extended out through the channel.

According to another aspect of the present invention, there is provided an ink-jet head comprising a passage unit, a reservoir unit that includes an ink reservoir for storing ink, an actuator unit, and a flexible cable. The passage unit includes a plurality of nozzles, a plurality of pressure chambers that communicate with the respective nozzles, and a common ink chamber that communicates with the pressure chambers. The reservoir unit, stacked on the passage unit, includes a confronting face confronting the passage unit. The confronting face includes a portion fixed to the passage unit and a portion spacedly confronting the passage unit. The ink reservoir communicates with the common ink chamber through an opening formed in the portion fixed to the passage unit. The actuator unit is fixed to a portion of the passage unit spacedly confronting the reservoir unit and applies ejection energy to ink contained in the pressure chambers. The flexible cable is connected with the actuator unit in order to supply a drive signal to the actuator unit. The passage unit and the reservoir unit respectively include a side face that crosses a direction perpendicular to a stacking direction of the passage unit and the reservoir unit. The reservoir unit includes a small-width portion having a smaller width than a width of the passage unit in the direction perpendicular to the stacking direction. The flexible cable extends away from the passage unit along a side face of the small-width portion of the reservoir unit in such way that, in the direction perpendicular to the stacking direction, a distance between the flexible cable and the side face of the small-width portion of the reservoir unit is smaller than a distance between the side face of the passage unit and the side face of the small-width portion of the reservoir unit.

In the foregoing constructions, since the flexible cable is extended out through the channel formed in the reservoir unit or is extended out along the side face of the small-width portion of the reservoir unit, the cable does not protrude out beyond a width of the reservoir unit. As a result, the head can be downsized as compared with a case where the flexible cable is extended out along an outer face of the reservoir unit.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

In the following, a certain preferred embodiment of the present invention will be described with reference to the accompanying drawings.

Figure 1:
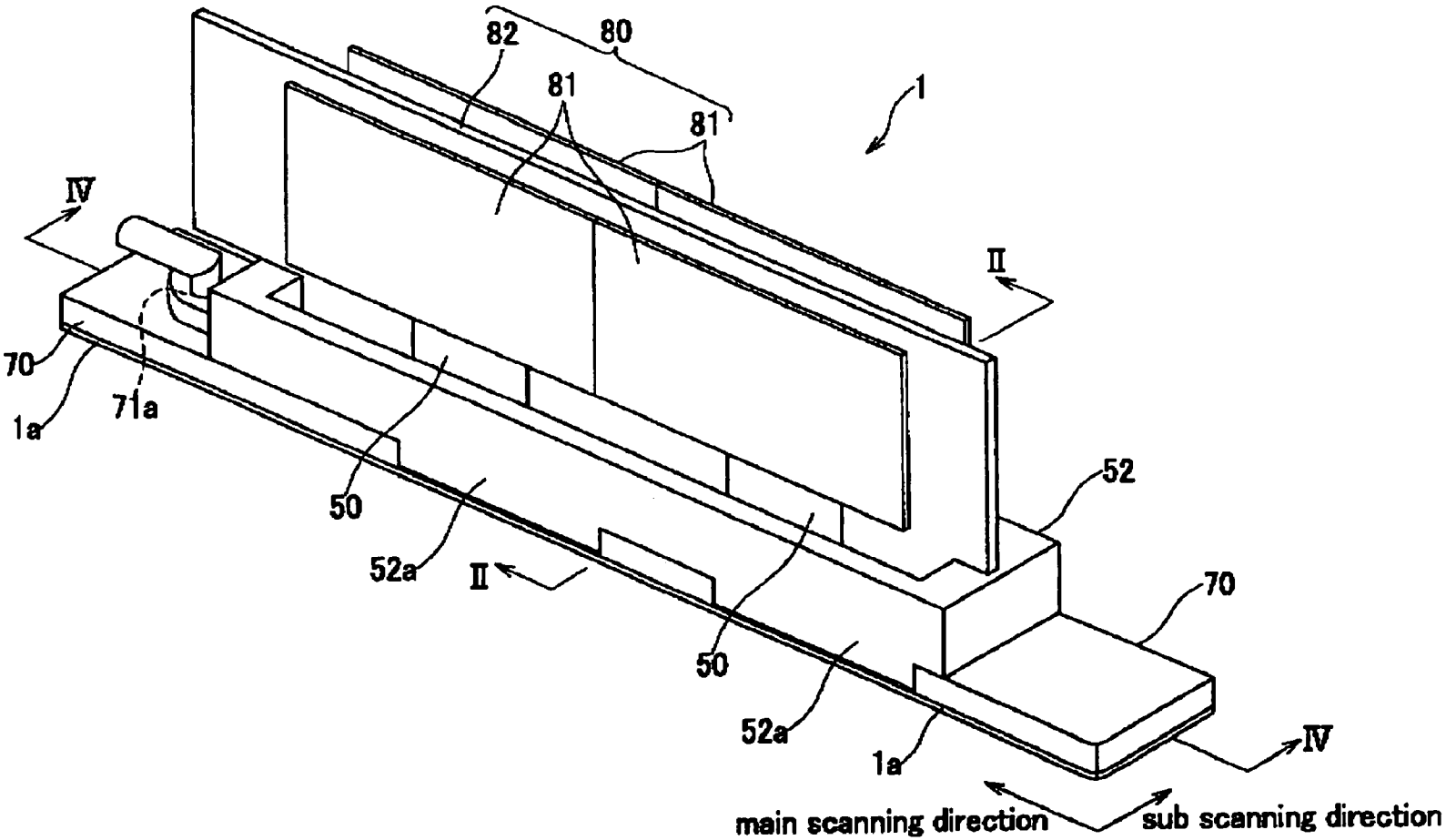
FIG. 1 is a perspective view of an ink-jet head according to an embodiment of the present invention.
Figure 2:
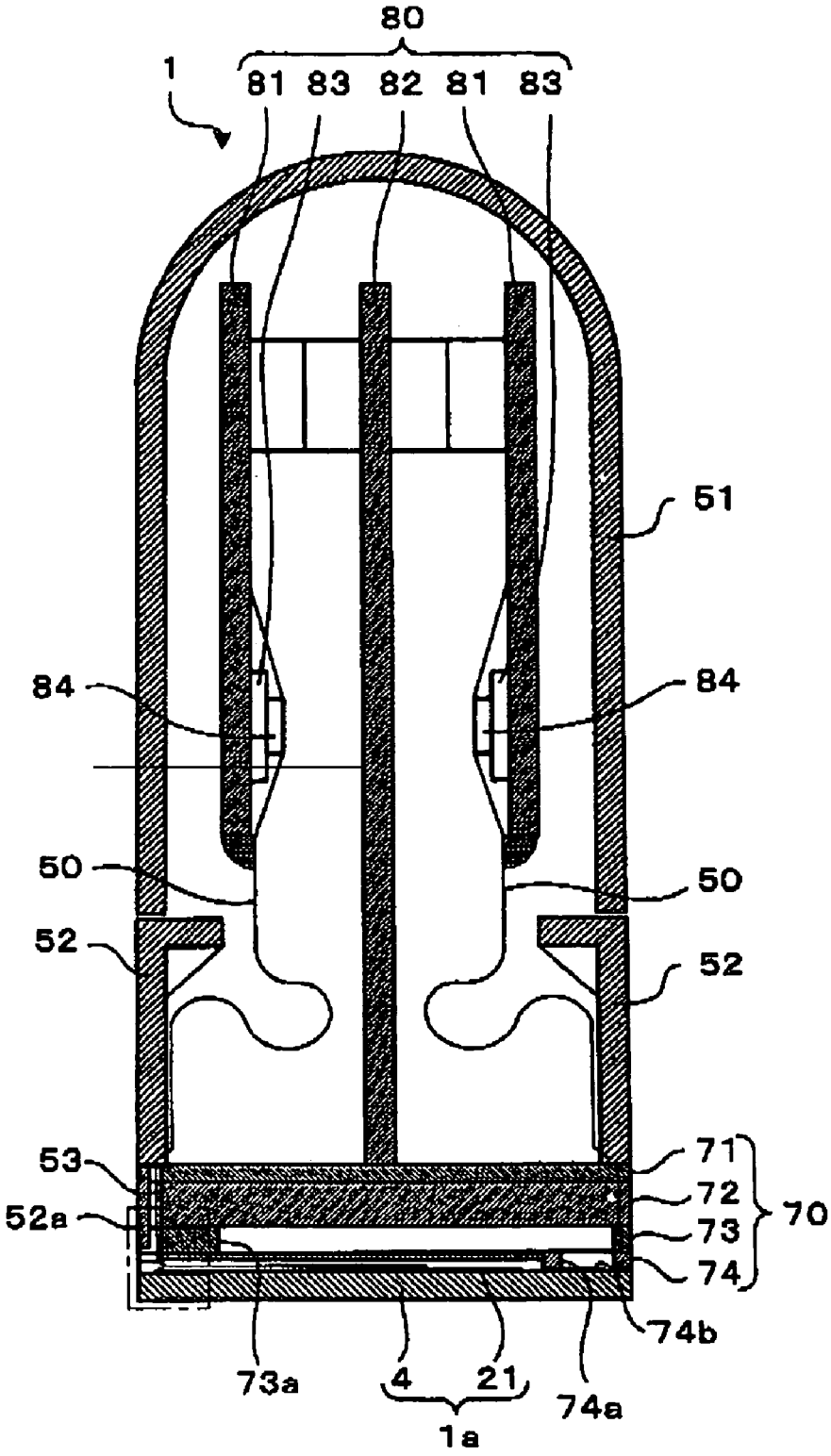
FIG. 2 is a sectional view taken along a line II-II of FIG. 1.

As illustrated in FIG. 1, an ink-jet head 1 according to an embodiment of the present invention has a shape elongated in a main scanning direction, and comprises, from its bottom side, a head main body 1*a*, a reservoir unit 70 (not shown in FIG. 1; see FIG. 2), and a control unit 80 that controls driving of the head main body 1*a*. As illustrated in FIG. 2, an upper covering 51 and a lower covering 52 are provided for the purpose of protecting against ink an upper part of the head including the control unit 80 and a lower part thereof including the reservoir unit 70, respectively. An illustration of the upper covering 51 is omitted from FIG. 1 so that the control unit 80 may be exposed into a visible state.

Here, referring to FIGS. 1 and 2, a construction of the control unit 80 will be described.

The control unit 80 includes a main substrate 82, two sub substrates 81 disposed on both sides of the main substrate 82, and driver ICs 83 (see FIG. 2) each fixed to a side face of each sub substrate 81 facing the main substrate 82.

The main substrate 82, whose plane extends in a vertical direction and in the main scanning direction, has a rectangular shape elongated in the main scanning direction and is perpendicularly fixed onto the reservoir unit 70. The two sub substrates 81 are laid in parallel with the main substrate 82, and disposed on both sides of the main substrate 82 to be equidistantly spaced apart therefrom. The two sub substrates 81 are electrically connected with the main substrate 82. The driver ICs 83 (see FIG. 2) generate signals for driving the actuator units 21 that are included in the head main body 1*a*. A heat sink 84 is fixed to a face of each driver IC 83 facing the main substrate 82.

The sub substrate 81 and the driver IC 83 fixed to each other make a pair, and each pair is electrically connected with an FPC 50 acting as a power supply member. The FPC 50 is, at its one end, connected with the actuator unit 21, too, so that the FPC 50 transmits to the driver IC 83 a signal outputted from the sub substrate 81, and feeds to the actuator unit 21 a drive signal outputted from the driver IC 83.

The upper covering 51 and the lower covering 52 will then be described.

As illustrated in FIG. 2, the upper covering 51 is a housing with an arched ceiling. The upper covering 51 covers the sub substrates 81 and an upper portion of the main substrate 82.

The lower covering 52 is a substantially rectangular-cylindrical housing that is opened out in its upper side and lower side. The lower covering 52 covers portions of the FPCs 50 which are extended out of a passage unit 4 included in the head main body 1*a*. Within a space covered by the lower covering 52, the FPCs 50 are laid in a loose manner in order to avoid stress put thereon.

At a top of the lower covering 52, ends of its sidewalls are bent at approximately 90 degrees to thereby form horizontal levels. On a joint portion of each horizontal level with the sidewall, placed is a lower open end of the upper covering 51.

Each sidewall of the lower covering 52 (only one of which is visible in FIG. 1) has, at its bottom end, two protrusions 52*a* protruding downward. The two protrusions 52*a* are disposed side by side along a lengthwise direction of the sidewall. Each protrusion 52*a* covers a portion of the FPC 50 disposed within a groove 53 of the reservoir unit 70, and at the same time the protrusions 52*a* are themselves received within the grooves 53 of the reservoir unit 70, as illustrated in FIG. 2. A tip end of the protrusion 52*a* confronts the passage unit 4 included in the head main body 1*a* with a certain clearance formed therebetween for absorbing manufacture errors. A silicone resin, etc., is packed into the clearance which is thereby sealed up. Except for the protrusions 52*a*, the bottom ends of the sidewalls of the lower covering 52 are disposed on the reservoir unit 70.

Figure 3:
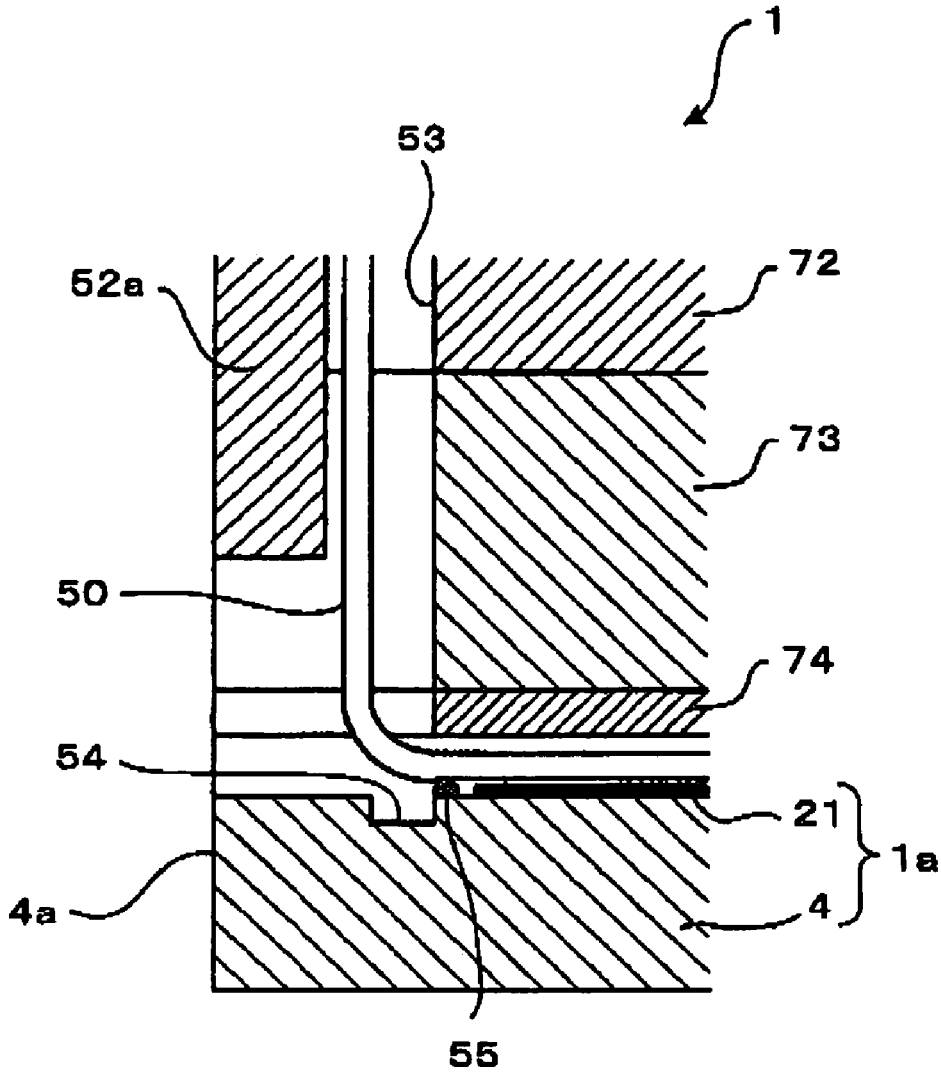
FIG. 3 is an enlarged view of a region enclosed with an alternate long and short dash line in FIG. 2.

As illustrated in FIG. 3, one end portion of the FPC 50 connected with the actuator unit 20 horizontally extends along a plane of the passage unit 4. Each FPC 50 is, while forming a bent portion in its midway, upwardly extended out through the groove 53 of the reservoir unit 70, so that the other end of the FPC 50 can be connected with the corresponding pair of sub substrate 81 and driver IC 83 of the control unit 80 (see FIG. 2). More specifically, the FPC 50 is extended out through a space that is defined by the protrusion 52*a* of the lower covering 52 and end faces of the reservoir unit 70 forming the groove 53. In other words, because a side face 4*a* of the passage unit 4 and a side face of the reservoir unit 70, which is one of three end faces forming the groove 53 and is parallel with the side face 4*a*, are spaced away from each other in the sub scanning direction, that is, the left and right direction in FIG. 3, a space is provided in a region neighboring the reservoir unit 70 in the sub scanning direction and neighboring the passage unit 4 in the vertical direction. The FPC 50 is extended out through this space.

On a top face of the passage unit 4, a recess 54 is formed to locate below the bent portion of the FPC 50 and to be spaced apart from the actuator unit 21. An adhesive 55 is put on the top face of the passage unit 4 to locate between the recess 54 and the actuator unit 21. Like this, the FPC 50 is, around its bent portion, bonded to the top face of the passage unit 4 by means of the adhesive 55, in order to avoid a separation of the FPC 50 from the actuator unit 21 during, e.g., extending out the FPC 50 upward. The recess 54 can receive not only the extra adhesive 55 but also a surplus of the silicone resin that is packed into the clearance between the passage unit 4 and the tip end of the protrusion 52*a* of the lower covering 52 for sealing up the clearance.

Both of the lower covering 52 and the upper covering 51 have substantially the same width as that of the passage unit 4 (see FIG. 2).

Figure 4:
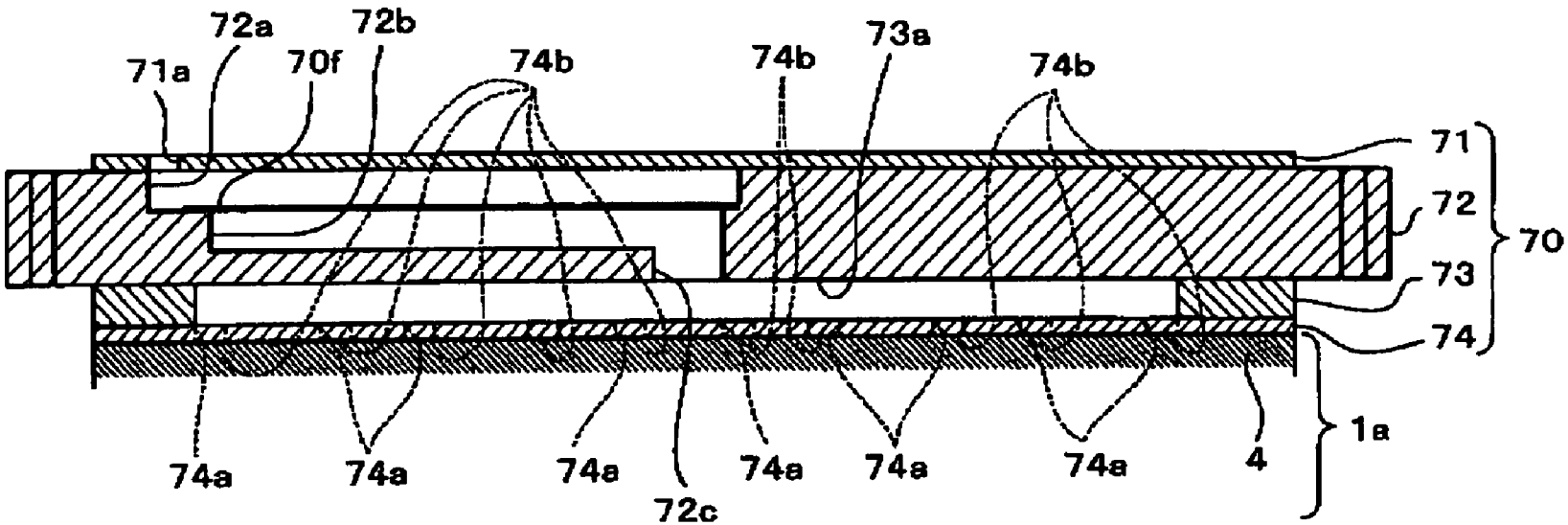
FIG. 4 is a sectional view of a reservoir unit taken along a line IV-IV of FIG. 1.

Then, referring to FIGS. 2, 4, and 5, a description will be given to a construction of the reservoir unit 70. For the purpose of explanatory convenience, FIG. 4 is drawn on an enlarged scale in the vertical direction.

The reservoir unit 70 has a layered structure of four plates, i.e., an upper plate 71, a filter plate 72, a reservoir plate 73, and an under plate 74. Each of the four plates 71 to 74 has substantially rectangular plan view shape elongated in the main scanning direction (see FIG. 1). Herein, a direction parallel with the elongated direction of the four plats 71 to 74 is referred to as a lengthwise direction of the four plates 71 to 74, a direction perpendicular to the lengthwise direction in a plan view is referred to as a widthwise direction of the four plates 71 to 74, and a direction perpendicular to both the lengthwise and widthwise directions is referred to as a thickness direction of the four plates 71 to 74.

Figure 5:
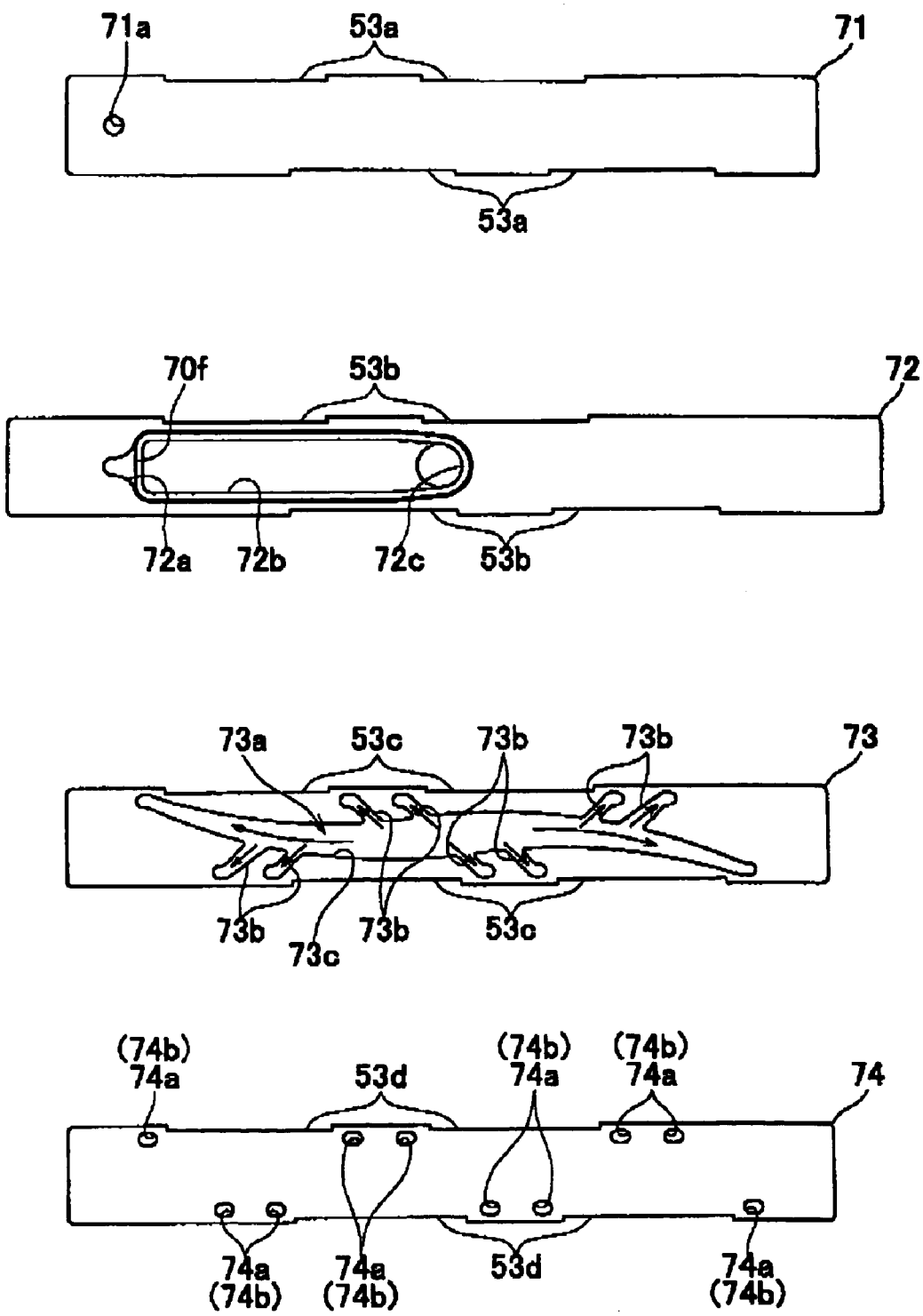
FIG. 5 is an exploded plan view of the reservoir unit illustrated in FIG. 4.

As illustrated in FIG. 5, the four plates 71, 72, 73, and 74 have, at their both widthwise ends, a total of four rectangular notches 53*a*, 53*b*, 53*c*, and 53*d*, respectively. At each widthwise end of each plate, two notches are formed side by side along a lengthwise direction of the plate. The four notches are arranged in a staggered pattern. These notches 53*a* to 53*d* are aligned with one another in the vertical direction to thereby form a groove 53 (see FIG. 2) that has a rectangular shape in a plan view and penetrates through the reservoir unit 70 in the vertical direction. Thus, two grooves 53 are formed on each widthwise side face of the reservoir unit 70, that is, a total of four grooves 53 are formed on its side faces. The four grooves 53 are arranged apart from one another in a staggered pattern along the length of the reservoir unit.

At one lengthwise end portion of the upper plate 71, a substantially circular hole 71*a* is formed in the middle of the width by means of etching, etc. The hole 71*a* penetrates through the upper plate 71 in its thickness direction.

As illustrated in FIG. 4, a first depression 72*a* is formed in the filter plate 72. The first depression 72*a* has a depth of approximately one third of a thickness of the filter plate 72. The first depression 72*a* is, in a plan view, elongated from a portion corresponding to the hole 71*a* to substantially a center of the filter plate 72. At the portion corresponding to the hole 71*a*, the first depression 72*a* is shaped in conformity with a shape of the hole 71*a* in a plan view. At substantially the center of the filter plate 72, the first depression 72*a* is shaped in conformity with a shape of a hole 72*c* in a plan view (see FIG. 5).

In the filter plate 72, further, a second depression 72*b* is formed under the first depression 72*a*, as illustrated in FIG. 4. A depth of the second depression 72*b* is approximately one third of the thickness of the filter plate 72. The second depression 72*b* and the first depression 72*b* have substantially the same shape, and the second depression 72*b* is somewhat smaller than the first depression 72*a* in a plan view.

A step is formed at a boundary between the first depression 72*a* and the second depression 72*b*. On this step, disposed is a filter 70*f* that removes dust and dirt contained in ink. The filter 70*f* has substantially the same shape as that of an area of the first depression 72*a* except for the portion corresponding to the hole 71*a* in a plan view. The filter 70*f* is slightly smaller than the area in a plan view.

In the filter plate 72, still further, a substantially circular hole 72*c* is formed under the second depression 72*b*. The hole 72*c* opens out in a bottom face of the filter plate 72. The hole 72*c* is formed substantially at the center of the filter plate 72.

An ink reservoir 73*a* that stores ink is formed in the reservoir plate 73 by press working, etc. The ink reservoir 73*a* penetrates through the reservoir plate 73 in its thickness direction. As illustrated in FIG. 5, the ink reservoir 73*a* curvedly extends along a length of the reservoir plate 73 while tapering toward its lengthwise ends. More specifically, the ink reservoir 73*a* is made up of a main passage 73*c* that extends along the length of the reservoir plate 73, and branch passages 73*b* that branch from the main passage 73*c*. A width of each branch passage 73*b* is narrower than that of the main passage 73*a*. Among the branch passages 73*b*, every two branch passages 73*b* extending in the same direction make a pair. Two pairs of branch passages 73*b* running in different directions from each other are extended out from each widthwise end of the main passage 73*c*. The two pairs of branch passages 73*b* are spaced apart from each other in its lengthwise direction. The four pairs branch passages 73*b* are disposed in a staggered pattern. A planer shape of the ink reservoir 73*a* is point-symmetrical with respect to a center of the reservoir plate 73.

In the ink reservoir 73*a*, both lengthwise ends of the main passage 73*c* and ends of the respective branch passages 73*b* correspond to portions of the under plate 74 where holes 74*a* are formed.

Ten holes 74*a* in total are formed in the under plate 74 by etching, etc. Each of the holes 74*a* has a substantially circular shape and penetrates through the under plate 74 in its thickness direction. A bottom end of the hole 74*a* forms an ink discharge port 74*b*. Five ink discharge ports 74*b* are disposed near each widthwise end of the under plate 74 in a staggered pattern along the lengthwise direction. More specifically, along one widthwise end of the under plate 74, one ink discharge port 74*b*, two ink discharge ports 74*b*, and two ink discharge ports 74*b* are spacedly disposed in this order from one side in the lengthwise direction. Along the other widthwise end of the under plate 74, one ink discharge port 74*b*, two ink discharge ports 74*b*, and two ink discharge ports 74*b* are spacedly disposed in this order from the other side in the lengthwise direction. The ink discharge ports 74*b* are so disposed as to keep away from the notches 53*d*. In other words, each ink discharge port 74*b* is disposed between two neighboring notches 53*d*. The ink discharge ports 74*b* are positioned point-symmetrically with respect to a center of the under plate 74.

When the four plates 71 to 74 are positioned relative to one another and put in layers, an ink passage as shown in FIGS. 4 and 5 is formed within the reservoir unit 70.

That is, ink is introduced from an ink supply source (not illustrated) such as an ink tank into the hole 71*a* via e.g., a tube (not illustrated) inserted into the hole 71*a*, and subsequently the ink flows into one end of the first depression 72*a* and spreads within the first depression 72*a* in a horizontal direction. The ink passes through the filter 70*f* for removing dust and dirt therefrom, and then reaches the second depression 72*b*. Thereafter, the ink flows through the hole 72*c* into substantially the center of the ink reservoir 73*a*, where the ink is temporarily stored. At this time, the ink having flown into substantially the center of the ink reservoir 73*a* spreads from a center of the main passage 73*c* toward the lengthwise ends thereof and toward the ends of the respective branch passages 73*b*, as shown by arrows in FIG. 5. Then, the ink passes through the respective holes 74*a* to be supplied into the passage unit 4 via the ink discharge ports 74*b* and ink receiving ports 5*b* (see FIG. 6).

As illustrated in FIG. 2, a bottom of the under plate 74 has been processed by half etching, etc., so that only a periphery of each ink discharge port 74*b* can protrudes downward. Since the ink discharge ports 74*b* are formed in the under plate 74 in the staggered pattern (see FIG. 5) as mentioned above, protrusions formed on the bottom of the under plate 74 are also arranged in a staggered pattern. The reservoir unit 70 is fixed to the top face of the passage unit 4 such that it can be in contact with the passage unit 4 only at these protrusions of the under plate 74 formed around the ink discharge ports 74*b* and its portions other than the protrusions can be spaced apart from the passage unit 4.

As illustrated in FIG. 2, except for the grooves 53, widthwise ends of the reservoir unit 70 are aligned with widthwise ends of the passage unit 4 in the vertical direction. In addition, a total width of the reservoir unit 70 including the lower covering 52 is substantially the same as the width of the passage unit 4.

Then, a description will be given to a construction of the head main body 1*a* with reference to FIGS. 2, 6, 7, 8, 9, 10A, and 10B. In FIG. 7, for the purpose of explanatory convenience, pressure chambers 10 and apertures 12 are illustrated with solid lines, though they locate below the actuator units 21 and therefore should be illustrated with broken lines.

Figure 6:
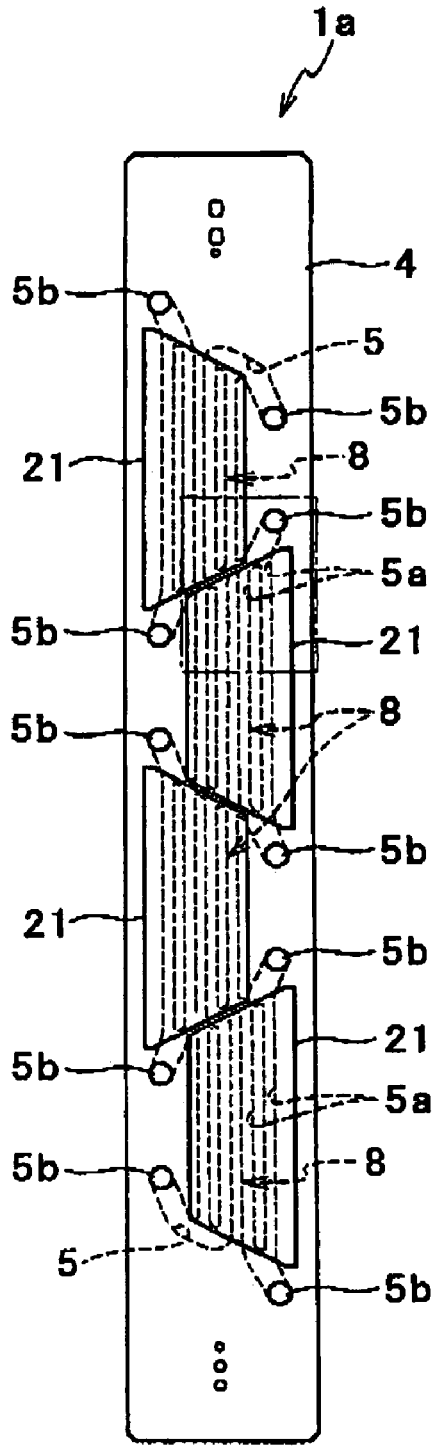
FIG. 6 is a plan view of a head main body illustrated in FIG. 1.
Figure 7:
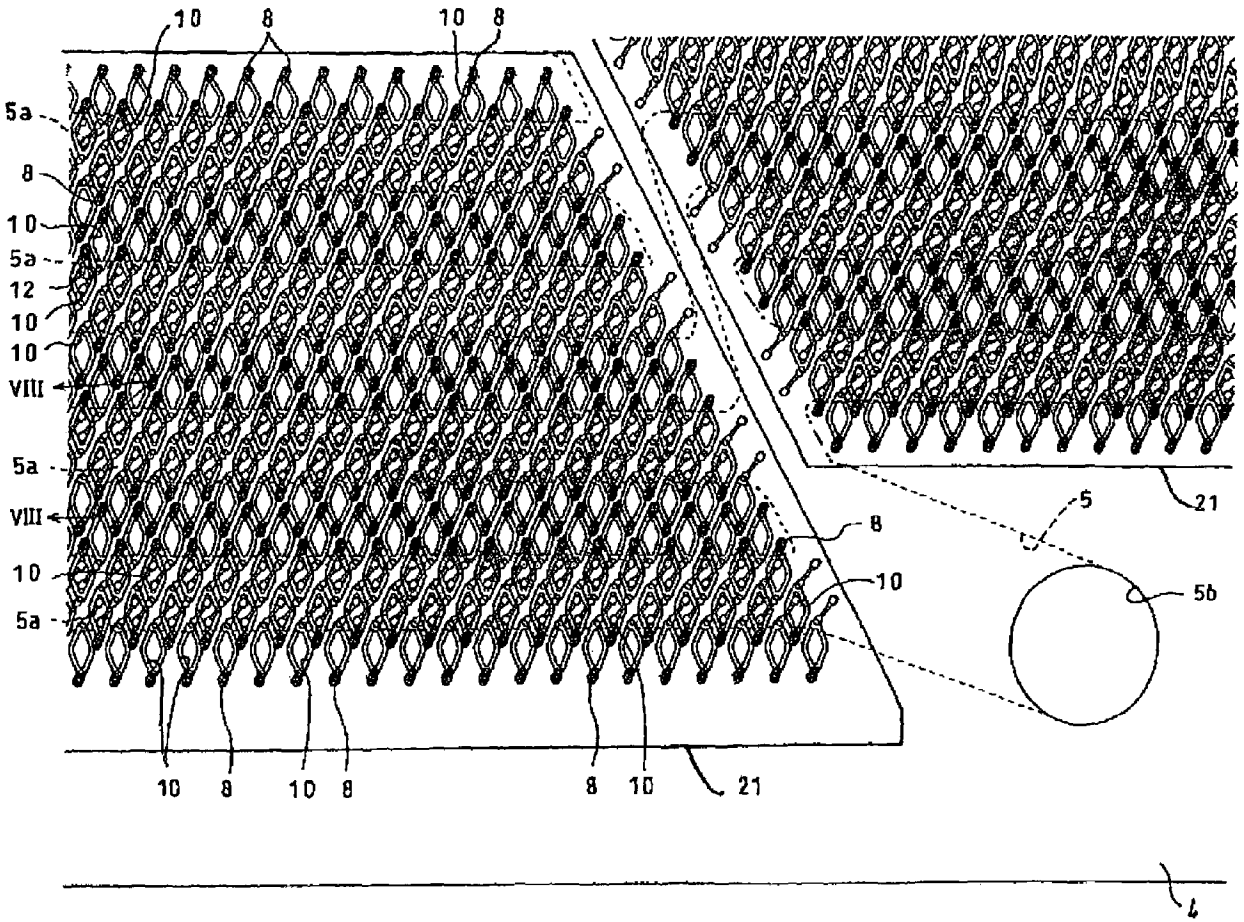
FIG. 7 is an enlarged view of a region enclosed with an alternate long and short dash line in FIG. 6.

As illustrated in FIGS. 2 and 6, the head main body 1*a* includes the substantially rectangular parallelepiped passage unit 4, and four actuator units 21 fixed to the top face of the passage unit 4. The plan view shape of the passage unit 4 has substantially the same shape and the same size as those of a plane of the reservoir unit 70 except for the grooves 53. The actuator units 21 serve to selectively apply ejection energy to ink contained in the pressure chambers that are formed in the passage unit 4. The actuator units 21 are fixed on such areas of the top face of the passage unit 4 as to spacedly confront the reservoir unit 70. The actuator units 21 are in no contact with the reservoir unit 70 and spaced apart therefrom.

As illustrated in FIG. 6, the four actuator units 21 each having a trapezoidal shape in a plan view are arranged on the top face of the passage unit 4 in a staggered pattern. The actuator units 21 are disposed such that parallel opposed sides of each actuator unit 21 may extend along a lengthwise direction, that is, an elongated direction of the passage unit 4 and oblique sides of every neighboring actuator units 21 may overlap each other in a widthwise direction, that is, a direction perpendicular to the elongated direction of the passage unit 4. The four actuator units 21 have such a relative positional relationship that they may locate equidistantly on opposite sides of a widthwise center of the passage unit 4.

As illustrated in FIGS. 6 and 7, an under face of the passage unit 4 provides ink ejection regions where a large number of nozzles 8 are formed in a matrix. A total of ten substantially circular ink receiving ports 5*b* are formed in areas of the top face of the passage unit 4 having no actuator unit 21 bonded thereon (i.e., areas of the top face of the passage unit 4 fixed to the reservoir unit 70). The ink receiving ports 5*b* are connected with the respective ink discharge ports 74*b* (see FIGS. 4 and 5) of the reservoir unit 70.

Figure 8:
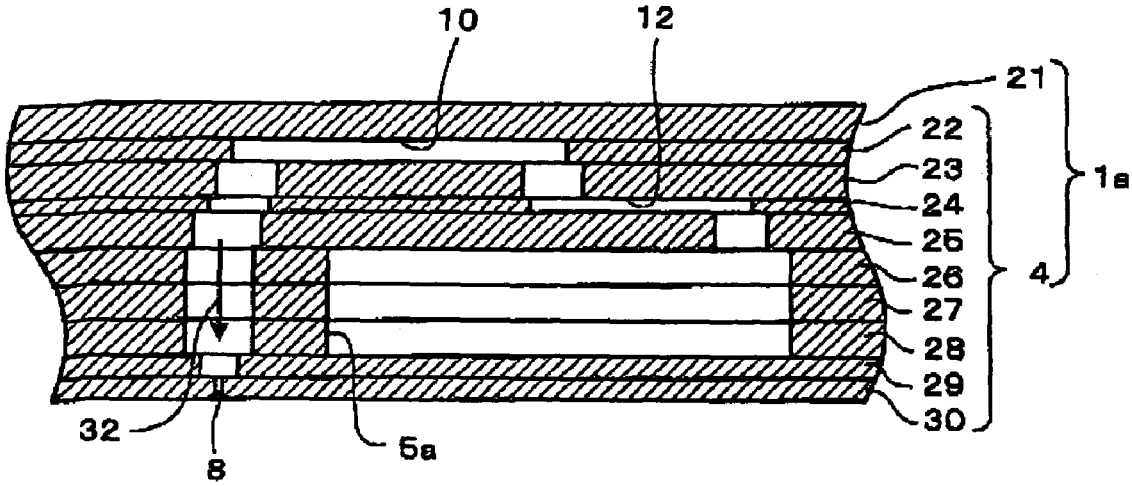
FIG. 8 is a local sectional view taken along a line VIII-VIII of FIG. 7.

The passage unit 4 also includes manifold channels 5 that communicate with the ink receiving ports 5*b*, and sub-manifold channels 5*a* that branch from the corresponding manifold channels 5 (see FIGS. 6 and 7). Ink passages 32, each of which corresponds to each nozzle 8 as illustrated in FIG. 8, are formed within the passage unit 4. Ink is introduced from the ink discharge ports 74*b* of the reservoir unit 70 into the ink receiving ports 5*b* of the passage unit 4, and then branches from the manifold channels 5 into the respective sub-manifold channels 5*a*, to subsequently reach the tapered nozzles 8 via the apertures 12 and the pressure chambers 10. Each aperture 12 functions as a throttle.

As illustrated in FIG. 7, the pressure chambers 10 each having a substantially rhombic shape in a plan view are, similarly to the nozzles 8, arranged in a matrix within the respective ink ejection regions.

Figure 9:
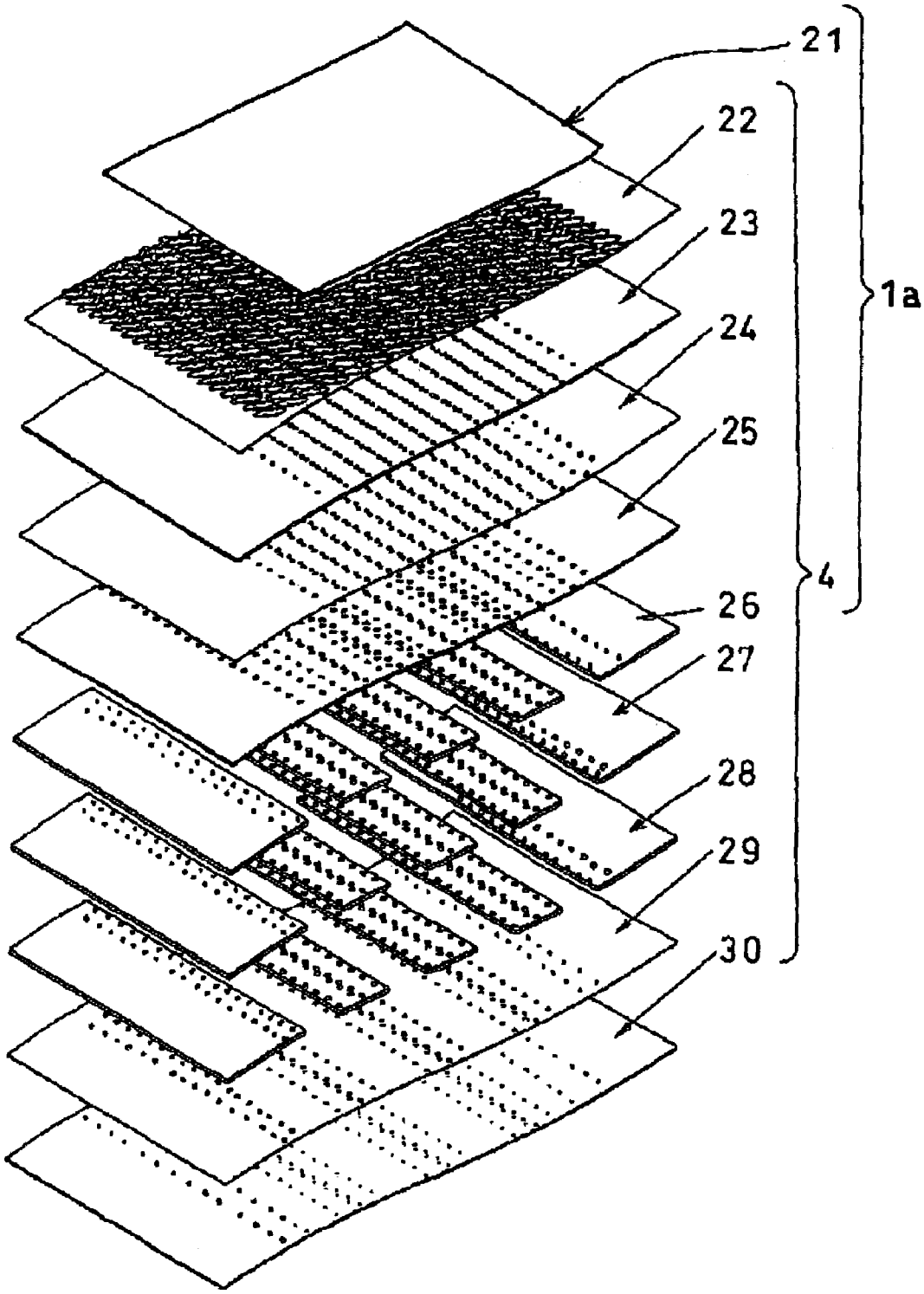
FIG. 9 is a local exploded perspective view of the head main body illustrated in FIG. 1.

Nine metal plates are positioned relative to one another and put in layers so as to form the aforementioned ink passages 32, to thereby constitute the passage unit 4 (see FIGS. 8 and 9). More specifically, the passage unit 4 is made up of, from its top, a cavity plate 22, a base plate 23, an aperture plate 24, a supply plate 25, manifold plates. 26, 27, and 28, a cover plate 29, and a nozzle plate 30.

The cavity plate 22 is made of metal, in which formed are a large number of substantially rhombic openings corresponding to the respective pressure chambers 10. The base plate 23 is made of metal, in which formed are communication holes for connecting the respective pressure chambers 10 of the cavity plate 22 with the corresponding apertures 12, and communication holes for connecting the respective pressure chambers 10 with the corresponding nozzles 8. The aperture plate 24 is made of metal, in which formed are not only the apertures 12 but also communication holes for connecting the respective pressure chambers 10 with the corresponding ink nozzles 8. Each aperture 12 is formed of two holes and a half-etched region connecting the two holes. The supply plate 25 is made of metal, in which formed are communication holes for connecting the respective apertures 12 with the corresponding sub-manifold channels 5*a*, and communication holes for connecting the respective pressure chambers 10 with the corresponding ink nozzles 8. The manifold plates 26, 27, and 28 are made of metal, in which formed are not only holes that cooperate with each other to constitute the respective sub-manifold channels 5*a* when these plates are put in layers, but also communication holes for connecting the respective pressure chambers 10 with the corresponding ink nozzles 8. The cover plate 29 is made of metal, in which formed are communication holes for connecting the respective pressure chambers 10 of the cavity plate 22 with the corresponding nozzles 8. The nozzle plate 30 is made of metal, in which formed are the nozzles 8 that correspond to the respective pressure chambers 10 of the cavity plate 22.

Figure 10A:
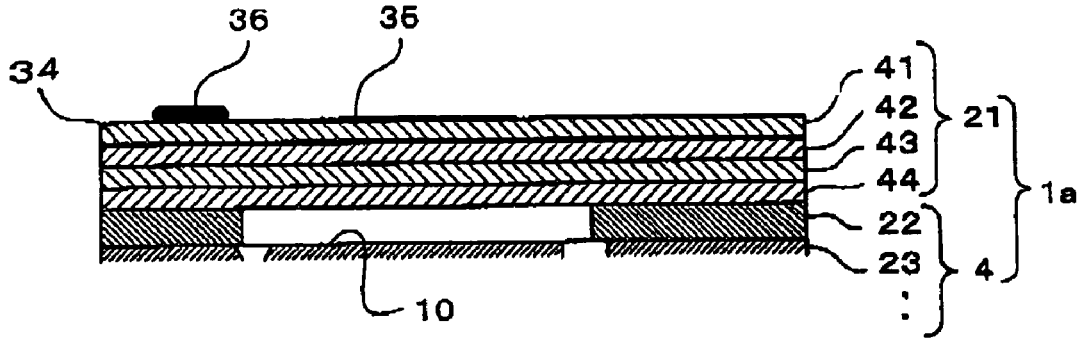
FIG. 10A is a local sectional view of an actuator unit illustrated in FIG. 8.

As illustrated in FIG. 10A, the actuator unit 21 is bonded onto the cavity plate 22 that constitutes the uppermost layer of the passage unit 4. The actuator unit 21 has a layered structure of four piezoelectric sheets 41, 42, 43, and 44 all made of a lead zirconate titanate (PZT)-base ceramic material having ferroelectricity. The four piezoelectric sheets 41 to 44 have the same thickness of approximately 15 μm in the vertical direction, and so disposed as to span the many pressure chambers 10 formed within one ink ejection region.

On the uppermost piezoelectric sheet 41, an individual electrode 35 is provided at a position corresponding to each pressure chamber 10. A common electrode 34 having a thickness of approximately 2 μm in the vertical direction is interposed between the uppermost piezoelectric sheet 41 and the piezoelectric sheet 42 located thereunder. The common electrode 34 is provided throughout entire surfaces of these piezoelectric sheets. Both the individual electrodes 35 and the common electrode 34 are made of, e.g., an Ag—Pd-base metallic material. No electrode is disposed between the piezoelectric sheets 42 and 43, and between the piezoelectric sheets 43 and 44.

Figure 10B:
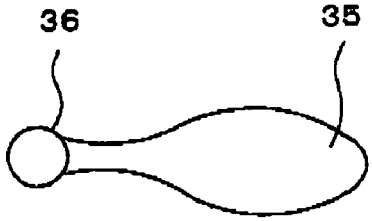
FIG. 10B is a plan view of an individual electrode that is disposed on a surface of the actuator unit in FIG. 10A.

As illustrated in FIG. 10B, the individual electrode 35 with a thickness of approximately 1 μm in the vertical direction has, in a plan view, a substantially rhombic shape similar to the shape of the pressure chamber 10 (see FIG. 7). One acute portion of the substantially rhombic individual electrode 35 is elongated out. The elongation has, on its end, a circular land 36 having a diameter of approximately 160 μm. The land 36 is electrically connected with the individual electrode 35. The land 36 is made of, e.g., gold including glass frits, and bonded onto a surface of the elongation of the individual electrode 35, as illustrated in FIG. 10A. The land 36 is electrically bonded to a contact formed in the FPC 50.

The common electrode 34 is grounded in a non-illustrated region. Thus, the common electrode 34 is kept at the ground potential equally in a region corresponding to any pressure chamber 10. On the other hand, the individual electrodes 35 are connected to the driver IC 80 (see FIG. 2) via the corresponding lands 36 and the FPC 50 that includes different lead wires adapted for the respective individual electrodes 35 in order that the individual electrodes 35 corresponding to the respective pressure chambers 10 can be controlled in their potentials independently of one another.

Since the piezoelectric sheets 41 to 44 span the many pressure chambers 10 as described above, the individual electrodes 35 can be arranged on the piezoelectric sheet 41 at a high density using, e.g., a screen printing technique. Therefore, the pressure chambers 10, which are positioned in correspondence with the individual electrodes 35, can also be arranged in a high density to thereby achieve a high-resolution image printing.

Here will be described how the actuator unit 21 drives.

Within the actuator unit 21, the piezoelectric sheet 41 has been polarized in its thickness direction. In this state, when the individual electrode 35 is set at a different potential from that of the common electrode 34 to thereby apply an electric field to the piezoelectric sheet 41 in the polarization direction, a portion of the piezoelectric sheet 41 having the electric field applied thereto works as an active portion that distorts through a piezoelectric effect. The active portion is, due to transverse piezoelectric effect, going to extend or contract in its thickness direction and contract or extend in its plane direction. On the other hand, the other three piezoelectric sheets 42 to 44 are inactive layers having no region sandwiched between the individual electrode 35 and the common electrode 34, and therefore cannot deform by themselves.

That is, the actuator unit 21 has a so-called unimorph structure in which an upper piezoelectric sheet 41 remote from the pressure chambers 10 constitutes a layer including active portions and the lower three piezoelectric sheets 42 to 44 near the pressure chambers 10 constitute inactive layers.

As illustrated in FIG. 10A, a bottom of the piezoelectric sheets 41 to 44 is fixed onto a top face of the cavity plate 22 in which the pressure chambers 10 are defined. Accordingly, when a difference in distortion in the polarization direction is caused between the portion of the piezoelectric sheet 41 having the electric field applied thereto and the other piezoelectric sheets 42 to 44 located thereunder, the piezoelectric sheets 41 to 44 are as a whole deformed into a convex shape toward the corresponding pressure chamber 10, which is called "unimorph deformation". In association with this deformation, the volume of the pressure chamber 34 decreases and thus pressure of ink rises, so that the ink is ejected from the corresponding nozzle 8.

Then, when the individual electrode 35 is returned to the same potential as that of the common electrode 34, the piezoelectric sheets 41 to 44 restore their original flat shape, and thus the pressure chamber 10 also restores its original volume. Ink is accordingly introduced from the manifold channel 5 into the pressure chamber 10 which therefore stores the ink again.

As described above, in the ink-jet head 1 of this embodiment, the FPC 50 is extended out though the groove 53 formed in the reservoir unit 70. Therefore, the FPC 50 does not protrude outward beyond the width of the reservoir unit 70. As a result, the head 1 can be downsized as compared with a case where the FPC is extended out along an outer face of the reservoir unit 70. In other words, the FPC 50 is extended out in such a way that, in a widthwise direction of the reservoir unit 70, a distance between the FPC 50 and the one face of three end faces forming the groove 53, which is parallel with the side face 4*a* of the passage unit 4, is smaller than a distance between the side face 4*a* of the passage unit 4 and the one face of three end faces forming the groove 53, which is parallel with the side face 4*a* of the passage unit 4. Therefore, the FPC 50 does not protrude outward beyond the width of the reservoir unit 70.

Besides, since the respective faces of the reservoir unit 70 and the passage unit 4 confronting each other have the substantially rectangular shape, the groove 53 can easily be formed. More specifically, the grooves 53 can be formed through a simple process, i.e., through forming the rectangular notches 53*a* to 53*d* in the respective plates 71 to 74 of the reservoir unit 70 as illustrated in FIG. 5.

In addition, except for the grooves 53, the widthwise ends of the reservoir unit 70 are aligned with the widthwise ends of the passage unit 4 in the vertical direction, as illustrated in FIG. 2. As a result, portions of the reservoir unit 70 except for the grooves 53 do not protrude out beyond the width of the passage unit 4, and therefore the head 1 can be downsized more reliably.

The plurality of grooves 53 are arranged apart from one another along the length of the reservoir unit 70. Therefore, the present invention is applicable when, as in this embodiment, the large number of nozzles 8 are formed in the passage unit 4 and the plurality of FPCs are extended out.

The ink discharge ports 74*b* are disposed in the respective intervals between the notches 53*d* that constitute the grooves 53 (see FIG. 4). In other words, the ink discharge ports 74*b*, which are positioned in correspondence with the respective ends of the main passage 73*c* and the branch passages 73*b* of the ink reservoir 73*a*, are so arranged as to keep away from the grooves 53. This configuration enables the ink reservoir 73*a* to have a relatively larger plane area, so that the capacity of the ink reservoir 73*a* can be well maintained even when the grooves 53 are formed.

In this embodiment, the FPC 50 is extended out through the groove 53 that is formed on the outer face of the reservoir unit 70. It is alternatively conceivable that, for example, the FPC 50 is extended out through a vertically-directed through-hole formed in the reservoir unit 70 away from the outer face of the reservoir unit 70. However, it is easier to form the groove 53 as in this embodiment, by which furthermore the FPC 50 can be extended out through a simple work. Moreover, the groove 53 can be obtained by notching out of the plates only a minimum area required for extending the FPC out, so that the other areas can be left unnotched. This is advantageous in terms of maintaining a good capacity of the ink reservoir 73*a*.

The ink-jet head 1 comprises the lower covering 52 having the protrusions 52*a* each of which covers the portion of the FPC 50 disposed within the groove 53. The FPC 50 is extended out through the space that is defined by the protrusion 52*a* of the lower covering 52 and the end faces of the reservoir unit 70 forming the groove 53. This construction provides more reliable protection for the FPCs 50 against external stress, foreign substances, and the like. Particularly in this embodiment, the FPC 50, which may be easily corroded by ink adhesion, is employed as a flexible cable connected with the actuator unit 21. Therefore, the effects obtained by covering the FPC 50 with the lower covering 52 become more significant.

The protrusions 52*a* of the lower covering 52 are received within the grooves 53 without protruding out beyond the width of the reservoir unit 70. This allows a downsizing of the head 1 even though the head 1 comprises a covering that covers the FPCs 50 as in this embodiment.

Further, since the total width of the reservoir unit 70 including the lower covering 52 is substantially the same as the width of the passage unit 4, reliability of the downsizing of the head 1 is more encouraged.

Still Further, the four actuator units 21 each having the trapezoidal shape in a plan view are disposed with the parallel opposed sides thereof extending along the lengthwise direction of the passage unit 4 and with neighboring oblique sides thereof overlapping each other in the widthwise direction of the passage unit 4, and at the same time the four actuator units 21 have such a relative positional relationship that they may locate equidistantly on opposite sides of the widthwise center of the passage unit 4. As a result, the plurality of actuator units 21 can be disposed within a narrow width, and accordingly the reservoir unit 70 and the passage unit 4 have a reduced width. Thus, the ink-jet head 1 can further be downsized.

The respective faces of the reservoir unit 70 and the passage unit 4 confronting each other may not always be rectangle, and a circular shape, etc., is also acceptable.

In addition, the respective faces of the reservoir unit 70 and the passage unit 4 confronting each other may not always have substantially the same shape and the same size.

Although, in the above-described embodiment, the widthwise ends of the reservoir unit 70 except for the grooves 53 are aligned with the widthwise ends of the passage unit 4 in the vertical direction, this is not limitative. For example, only one widthwise end of the reservoir unit 70 can be aligned with one widthwise end of the passage unit 4, or alternatively both widthwise ends of the reservoir unit 70 and those of the passage unit 4 can be out of alignment with each other.

The present invention is not limited to the construction in which, as in the above-described embodiment, the plurality of grooves 53 are arranged apart from one another along the length of the reservoir unit 70. For example, the reservoir unit 70 may have a single groove through which the plurality of FPC 50 are extended outward.

It is not always required that the ink discharge ports 74*b* are disposed in the respective intervals between the notches 53*d* that constitute the grooves 53, and they may be disposed at any arbitrary positions.

Instead of the grooves 53, through-holes through which the FPCs 50 are to be extended outward may be formed in the reservoir unit 70 away from the outer face of the reservoir unit 70.

It is also acceptable that the protrusions 52*a* of the lower covering 52 are not received within the grooves 53 and thus protrude out beyond the width of the reservoir unit 70. In addition, the total width of the reservoir unit 70 including the lower covering 52 can be different from the width of the passage unit 4. Further, the upper covering 51 and the lower covering 52 can be omitted.

The actuator units can also be variously changed in its number, shape, arrangement, and the like.

An application of the present invention is not limited to ink-jet printers. The present invention is applicable also to, for example, ink-jet type facsimile or copying machines.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet comprising:

a passage unit including a plurality of nozzles that eject ink, a plurality of pressure chambers that communicate with respective nozzles of the plurality of nozzles, and an ink receiving port opening thereon and communicating with the plurality of pressure chambers;

a reservoir unit including an ink discharge port opening thereon and an ink reservoir that stores ink, the reservoir unit being fixed to the passage unit such that a portion thereof can spacedly confront the passage unit with the ink discharge port and the ink receiving port connected with each other, to thereby supply the ink stored within the ink reservoir into the passage unit via the ink discharge port and the ink receiving port;

an actuator unit that is fixed to a portion of the passage unit spacedly confronting the reservoir unit and applies ejection energy to ink contained in the pressure chambers; and a flexible cable connected with the actuator unit in order to supply a drive signal to the actuator unit; and a covering that covers at least a portion of the flexible cable;

wherein:

a channel is formed in the reservoir unit, the channel penetrating through the reservoir unit in a direction across a face of the passage unit where the actuator unit is fixed;

the flexible cable connected with the actuator unit is extended out through the channel;

the channel is configured as a groove formed on an outer surface of the reservoir unit;

the covering covers at least a portion of the flexible cable disposed within the groove;

the flexible cable extends out through a space that is defined by the covering and one or more end faces of the reservoir unit forming the groove; and a portion of the covering that covers the flexible cable is received within the groove.

2. The ink-jet head according to claim 1, wherein faces of the reservoir unit and the passage unit confronting each other have a substantially rectangular shape.

3. The ink-jet head according to claim 1, wherein an end of the reservoir unit with respect to an extending direction of a face of the passage unit where the actuator unit is fixed and an end of the passage unit with respect to the extending direction of the face of the passage unit are, except for the channel, aligned with each other in a direction perpendicular to the face of the passage unit.

4. The ink-jet head according to claim 1, wherein a plurality of channels are arranged apart from one another along a lengthwise direction of the reservoir unit.

5. The ink-jet head according to claim 4, wherein the ink discharge port is disposed in an interval between the plurality of channels neighboring each other.

6. The ink-jet head according to claim 1, wherein a total width of the reservoir unit including the covering is equal to or smaller than a width of the passage unit.

7. An ink-jet head comprising:

a passage unit including a plurality of nozzles that eject ink, a plurality of pressure chambers that communicate with respective nozzles of the plurality of nozzles, and an ink receiving port opening thereon and communicating with the plurality of pressure chambers;

a reservoir unit including an ink discharge port opening thereon and an ink reservoir that stores ink, the reservoir unit being fixed to the passage unit such that a portion thereof can spacedly confront the passage unit with the ink discharge port and the ink receiving port connected with each other, to thereby supply the ink stored within the ink reservoir into the passage unit via the ink discharge port and the ink receiving port;

a plurality of actuator units that are fixed to portions of the passage unit spacedly confronting the reservoir unit and apply ejection energy to ink contained in the pressure chambers;

a plurality of flexible cables each connected with each of the plurality of actuator units in order to supply drive signals to the actuator units; and a covering that covers at least a portion of the flexible cables;

wherein:

a plurality of grooves are formed on an outer surface of the reservoir unit, the grooves penetrating through the reservoir unit in a direction perpendicular to a face of the passage unit where the actuator units are fixed;

the flexible cables connected with the actuator units are extended out through the respective grooves;

faces of the reservoir unit and the passage unit confronting each other have a substantially rectangular shape of substantially a same shape and a same size;

the plurality of actuator units are arranged in a staggered pattern along a lengthwise direction of the passage unit;

the plurality of grooves formed on the reservoir unit are arranged in a staggered pattern along a lengthwise direction of the reservoir unit such that each of the plurality of grooves can correspond to each of the plurality of the actuator units;

the ink discharge port is disposed in an interval between grooves of the plurality of grooves neighboring each other;

the covering covers at least a portion of the flexible cables disposed within the grooves;

the flexible cables extend out through a space that is defined by the covering and one or more end faces of the reservoir unit forming the grooves; and a portion of the covering that covers the flexible cables is received within the grooves.

8. The ink-jet head according to claim 7 wherein:

each of the plurality of actuator units has a trapezoidal shape in a plan view; and the plurality of actuator units are disposed with parallel opposed sides thereof extending along the lengthwise direction of the passage unit and with neighboring oblique sides thereof overlapping each other in a widthwise direction of the passage unit, and the plurality of actuator units have such a relative positional relationship that they can locate equidistantly on opposite sides of a widthwise center of the passage unit.

9. An ink-jet head comprising:

a passage unit including a plurality of nozzles, a plurality of pressure chambers that communicate with respective nozzles of the plurality of nozzles, and a common ink chamber that communicates with the pressure chambers;

a reservoir unit that includes an ink reservoir for storing ink, the reservoir unit being stacked on the passage unit, the reservoir unit including a confronting face confronting the passage unit, the confronting face including a portion fixed to the passage unit and a portion spacedly confronting the passage unit, the ink reservoir communicating with the common ink chamber through an opening formed in the portion fixed to the passage unit;

an actuator unit that is fixed to a portion of the passage unit spacedly confronting the reservoir unit and applies ejection energy to ink contained in the pressure chambers;

a flexible cable that is connected with the actuator unit in order to supply a drive signal to the actuator unit; and a covering that covers at least a portion of the flexible cable;

wherein:

the passage unit and the reservoir unit respectively include a side face that crosses a direction perpendicular to a stacking direction of the passage unit and the reservoir unit;

the reservoir unit includes a small-width portion having a smaller width than a width of the passage unit in the direction perpendicular to the stacking direction;

the flexible cable extends away from the passage unit along a side face of the small-width portion of the reservoir unit in such way that, in the direction perpendicular to the stacking direction, a distance between the flexible cable and the side face of the small-width portion of the reservoir unit is smaller than a distance between the side face of the passage unit and the side face of the small-width portion of the reservoir unit;

a groove is formed in a side face of the reservoir unit, the groove penetrating through the reservoir unit in the stacking direction, the flexible cable extending through the groove;

the covering covers at least a portion of the flexible cable disposed within the groove;

the flexible cable extends out through a space that is defined by the covering and one or more end faces of the reservoir unit forming the groove; and a portion of the covering that covers the flexible cable is received within the groove.

10. The ink-jet head according to claim 9 wherein faces of the reservoir unit and the passage unit confronting each other have a substantially rectangular shape.

11. The ink-jet head according to claim 10, wherein the side face of the passage unit corresponds to a side face of the reservoir unit except for the side face of the small-width portion.

12. The ink-jet head according to claim 10, wherein a total width of the reservoir unit including the covering is equal to or smaller than a width of the passage unit.

13. The ink-jet head according to claim 10, wherein a plurality of the grooves are arranged apart from one another on the side faces of the reservoir unit.

14. The ink-jet head according to claim 13, wherein the opening through which the ink reservoir communicates with the common ink chamber is disposed in an interval between the grooves neighboring each other.

* * * * *